US008344296B2

(12) United States Patent
Metz et al.

(10) Patent No.: US 8,344,296 B2
(45) Date of Patent: Jan. 1, 2013

(54) FOOD WARMING DEVICE AND SYSTEM

(75) Inventors: Reinhard Metz, Wheaton, IL (US); Warren Graber, Hoffman Estates, IL (US)

(73) Assignee: CookTek Induction Systems, LLC, Chicago, IL (US)

( * ) Notice: Subject to any disclaimer, the term of this patent is extended or adjusted under 35 U.S.C. 154(b) by 1159 days.

(21) Appl. No.: 11/869,822

(22) Filed: Oct. 10, 2007

(65) Prior Publication Data

US 2009/0095736 A1 Apr. 16, 2009

(51) Int. Cl.
*H05B 6/12* (2006.01)
*H05B 6/08* (2006.01)

(52) U.S. Cl. ..... 219/620; 219/621; 219/625; 219/627; 219/667

(58) Field of Classification Search ..... 219/620–622, 219/626, 627, 663, 667, 624, 665, 625; 126/246; 340/572.1, 825.37; 99/451, DIG. 14
See application file for complete search history.

(56) References Cited

U.S. PATENT DOCUMENTS

| | | | | |
|---|---|---|---|---|
| 2,065,760 | A | 12/1936 | Smith | |
| 2,527,720 | A | 10/1950 | Guyer | |
| 3,263,063 | A | 7/1966 | Marriott et al. | |
| 3,786,220 | A * | 1/1974 | Harnden, Jr. | 219/622 |
| 4,031,356 | A | 6/1977 | Niibe | |
| 4,248,015 | A | 2/1981 | Stromquist et al. | |
| 4,929,005 | A | 5/1990 | Heinen | |
| 5,170,040 | A | 12/1992 | Wirtz et al. | |
| 5,594,316 | A | 1/1997 | Hayashida | |
| 5,714,199 | A | 2/1998 | Gerhardinger et al. | |
| 5,852,284 | A | 12/1998 | Teder et al. | |
| 6,024,084 | A | 2/2000 | Gerhardinger | |
| 6,144,017 | A | 11/2000 | Millett et al. | |
| 6,184,837 | B1 | 2/2001 | Lindenmeier et al. | |
| 6,320,169 | B1 * | 11/2001 | Clothier | 219/626 |
| 6,534,753 | B1 * | 3/2003 | Boyd et al. | 219/663 |
| 6,535,133 | B2 | 3/2003 | Gohara | |
| 6,736,646 | B2 | 5/2004 | Takahashi et al. | |
| 6,953,919 | B2 * | 10/2005 | Clothier | 219/620 |
| 7,041,942 | B2 | 5/2006 | Gerhardinger | |
| 7,053,343 | B2 | 5/2006 | Gerhardinger et al. | |

FOREIGN PATENT DOCUMENTS

| | | |
|---|---|---|
| DE | 19818132 A1 | 12/1999 |
| JP | 11054711 | 9/2000 |
| JP | 11229372 | 2/2001 |
| JP | 2002279406 | 4/2004 |
| JP | 2006294372 A * | 10/2006 |

(Continued)

OTHER PUBLICATIONS

English Translation of Disclosure of Watanabe et al. JP 2006344453, Dec. 2006.*

(Continued)

*Primary Examiner* — Henry Yuen
*Assistant Examiner* — Hung D Nguyen
(74) *Attorney, Agent, or Firm* — Michael P. Mazza, LLC

(57) ABSTRACT

An apparatus, system and method for warming food by controlled heating of heat retention objects such as cookware items or pellets located on a trivet positioned on a countertop, using heating control units, such as induction heating units, remotely located beneath the countertop. The preferred trivet insulates the countertop against damages, and also includes circuitry enabling the indication or display of its proper positioning on the countertop, and also indicating whether the heating unit is heating the heat retention object.

18 Claims, 5 Drawing Sheets

FOREIGN PATENT DOCUMENTS

| | | | |
|---|---|---|---|
| JP | 2006344453 A | * | 12/2006 |
| WO | WO9626449 | | 8/1996 |

OTHER PUBLICATIONS

English Translation of Abstract of Watanabe et al. JP 2006344453, Dec. 2006.*

English Translation of Disclosure of Minatoya et al. JP 2006294372, Oct. 2006.*

English Translation of Abstract of Minatoya et al. JP 2006294372, Oct. 2006.*

Trivet; http://en.wikipedia.org/wiki/Trivet.

* cited by examiner

FOOD WARMING DEVICE AND SYSTEM

BACKGROUND OF THE INVENTION

U.S. Ser. No. 11/750,571, filed May 18, 2007, titled "Detachable Tag-Based Temperature Sensor For Use In Heating Of Food And Cookware," assigned to the present assignee, is hereby incorporated by reference in its entirety into this patent application.

The present invention generally relates to devices used to heat the contents of cookware such as dishes, buffet trays and the like. More particularly, the invention relates to a heating device and system, such as for induction heating of objects such as cookware or food containers through stone or other materials on which cookware may be placed.

Various methods are known for heating cookware and food containers. As one example, radio-frequency identification (RFID) tagging systems have been used to activate and control magnetic induction heating systems for use in heating foods and associated food containers, cookware and warming/heat retention objects. Use of such systems allows objects not physically connected to a magnetic induction heater to be heated and temperature-regulated using RFID technology. In such systems, an RFID tag having a temperature sensor are mounted within the item to be heated, such as cookware; an RFID reader is located within the magnetic induction heater unit. When the tagged object comes within the reading field of the RFID reader, the tag may be used to transmit information such as temperature and the class of object being heated, so that the heater control circuitry may use the information to commence an appropriate heating cycle for heating and temperature-regulating the object. Various such systems are available, including those disclosed in U.S. Pat. Nos. 6,025,725 to Gershenfeld et al., and 6,320,169 and 6,953,919 to Clothier, the entire disclosures of each of these three patents hereby being incorporated by reference herein. Use of this technology enables relatively precise heating and temperature regulation.

Other non-contact/indirect, remote control methods are known or may be devised. As non-limiting examples, remote controller devices used with televisions typically operate based on optical (infrared) communication. Non-contact modes of communication other than RFID may be used, likewise, for measuring the temperature of cookware and food containers, such as those involving communication via optical means, ultrasound, infrared, or other communication modes.

Induction heating of cookware may be accomplished by mounting the cookware on a range or countertop. Often, it may be desirable to hide the induction heating unit beneath a countertop made of stone (e.g., granite, man-made composites such as silestone, etc.) or other materials (e.g., formica, glass, wood, etc.), which may be typically about 3 centimeters thick, as a rough exemplary range of thickness. The countertop carries the cookware, which may be induction-heated by conveyance of magnetic field waves passing through the stone. Due to its combustive nature, the use of wood may not be desirable. Stone and composites present problems in this application, as market experience and the inventors' own testing have shown that the substantial temperature variations involved in warming or heating of food containers or cookware tends to crack the stone or generate surface damage (mechanical and/or visual).

For warming food or liquid items held for serving, the U.S.D.A. sets 145° F. as a minimum holding temperature. Typically, because it is not desired to boil the food or liquid item, 180° F.-190° F. is the top range. The resulting temperature variations have proved problematic when using countertops made of stone or other materials due to cracking or surface damage issues.

Another problem encountered when using a stone, composite or other countertop covering an induction heating unit has been how to locate the cookware on the countertop so that it is properly positioned for heating activation within the radio tagging transmission area of the induction heating unit, as well as being optimally positioned for the induction heating process. Two factors complicate this problem. First, it may be desirable to have a "clean" countertop, devoid of markings, logos, designs, etc. Second, it may be desirable to have induction heater (e.g., buffet) units, for example, slidably mounted on tracks beneath the countertop, so that their location can change beneath the countertop. Accordingly, it would be advantageous to provide a way of indicating to the user when the cookware is properly located over the induction heating unit, and also to indicate whether the heating unit is currently heating the heat retention object.

Still another problem encountered in the industry of warming food items using cookware is how to control the temperature of the cookware remotely, using indirect heating.

It would also be advantageous to provide a cookware-warming device that may be used with any cookware, such that it need not be specially designed to have induction heating apparatus (e.g., an RFID tag) attached to it.

Accordingly, it would be advantageous to provide a cookware heating device and system that solves the problems recited above, while providing new advantages not currently available.

DEFINITION OF CLAIM TERMS

The following terms are used in the claims of the patent as filed and are intended to have their broadest meaning consistent with the requirements of law. Where alternative meanings are possible, the broadest meaning is intended. All words used in the claims are intended to be used in the normal, customary usage of grammar and the English language.

"Cookware" means cooking, serving or delivery containers for warming or heating food, including but not limited to dishes, pots, trays including buffet trays and warming trays, etc.

"Food" means any item or material which may be normally ingested by humans, including solid or liquid matter.

"Food container" means any container for warming food or for maintaining food in a warmed condition, such as but not limited to pizza delivery trays, food bags, etc.

"Heat retention object" means any object, such as cookware, pellets, or other objects, which may function to receive heat from indirect heating methods such as induction heating, and which may be used to heat or warm food or to maintain food in a generally heated or warmed condition.

"Indirect heater" or "indirect heating" or "indirect heating system" means a heater or method of heating, or system involving such heating, respectively, in which food contained by an item of cookware or other cooking, serving or delivery food container, is heated through conduction of heat from the cookware or container to the food.

"Reader" means a device capable of receiving information from a tag relevant to the heating of cookware of other cooking-, serving-, or delivery-related food containers, and of transmitting this information to heating controls associated with an indirect heater.

"RFID technology" means a tagging system including but not limited to a tag having information regarding an object, such as its temperature, humidity, volume or weight, and a reader in communication with the tag and with an appliance such as an induction heater separated by some distance from the tag.

"Tag" means a device possessing information relevant to the heating of cookware or other cooking-, serving- or delivery-related food containers, that is capable of transmitting sensor information such as but not limited to temperature, humidity, volume or weight to a reader associated with heating controls of an indirect heater, which communication may occur through the mode of RFID, optical, ultrasound, or other modes.

"Trivet" means an object located between cookware used to warm or heat food, on the one hand, and a countertop, range, table or other surface for supporting the cookware, on the other, and which is used as an insulator to protect the supporting surface from heat damage. A "trivet" within the meaning of this invention may but does not necessarily include an induction heating, sensing and/or communications device such as an RFID tag attached to it; alternatively, such a device may be attached to the cookware. In addition, a "trivet" within the meaning of this invention may but does not necessarily include circuitry communicating with the heater unit and/or user to indicate whether the trivet is properly positioned and whether the heater unit is currently heating the heat retention object.

SUMMARY OF THE INVENTION

The objects mentioned above, as well as other objects, are solved by the present invention, which overcomes disadvantages of prior tagging objects and systems used with heating devices for cooking and/or warming applications, while providing new advantages not previously obtainable with such tagging objects and systems.

In a preferred embodiment, an apparatus is provided for measuring and controlling the temperature of a heat retention object such as a food container, an item of cookware, a heat-retentive pellet, or another heat retention object, which may be used to warm or keep warm a food item. A trivet is provided in contact with the heat retention object. The trivet rests on a countertop, which may be made from one or more of the following materials: stone; composites; formica; glass; ceramic; or wood. The trivet acts as an insulator to limit the amount of heat transferring from the heat retention object through the trivet to the countertop. A tag may be associated with the heat retention object or, alternatively, with the trivet. The tag is capable of communication with a reader associated with a heating control unit located below the countertop, enabling controlled heating of the heat retention object or, alternatively, the trivet. Preferably, the trivet indicates when it is properly positioned on the countertop so as to allow proper heating of an object by the heating control unit; this may be accomplished using electronic circuitry powering a display such as an LED, which may also indicate whether the heating control unit is currently heating the heat retention unit. If the heating control unit is an induction heater, then RFID tags and RFID readers may be employed, and proper positioning of the trivet may entail locating the trivet within the magnetic field of the induction heater located beneath the countertop.

In order for the trivet to limit conducted and radiated heat from damaging the countertop, the trivet is preferably made of appropriate insulating materials and/or has a limited footprint in contact with the countertop and/or the heatable object. For this purpose, a preferred trivet may include channels or cavities on its lower portion in contact with the countertop; legs may also be employed. Pick-up and associated electronic circuitry may be located within these channels or cavities, as may tags and readers, for example.

In a preferred embodiment, a coupler mechanism may carry the tag. The coupler mechanism may be removably magnetically attached to the heat retention object. Alternatively, the coupler may be magnetically attached to the trivet; in this event, the trivet may be constructed of an upper, magnetic portion to which the coupler is removably attached, and a lower, insulating, non-magnetic portion. Alternatively, if the coupler is to be removably attached to a non-metallic portion of the heat retention object or trivet, double-sided adhesive tape may be used, for example. The preferred magnetic coupler may include a housing in which the tag is located, and a tongue portion having a temperature sensor. The tongue portion may be in abutting contact with the heat retention object when the magnetic coupler is magnetically coupled to it. An antenna may be used with the heating unit to facilitate communication between the tag and the reader; preferably, the coupler housing has a length sufficient to allow positioning of the tag within the housing at a location which is within a reception area of the antenna.

A system for measuring and controlling temperatures of heat retention objects, such as food containers, items of cookware, heat retentive pellets, or other heat retention objects, used to warm or to keep warm food also forms part of the present invention. A preferred embodiment of such a system includes a trivet supporting the heat retention object and resting on a countertop. The trivet insulates the countertop from heat generated in the heat retention object which may travel from the heat-generating source to the countertop. A tag may be associated with either the trivet or the heat retention object. A heater control unit is also provided, such as an induction heater, in communication with a reader capable of receiving information from the tag. This enables directly controlled heating of either the trivet or the heat retention object, depending on which is associated with the tag.

BRIEF DESCRIPTION OF THE DRAWINGS

The novel features which are characteristic of the invention are set forth in the appended claims. The invention itself, however, together with further objects and attendant advantages thereof, will be best understood by reference to the following description taken in connection with the accompanying drawings, in which:

Figure 1:
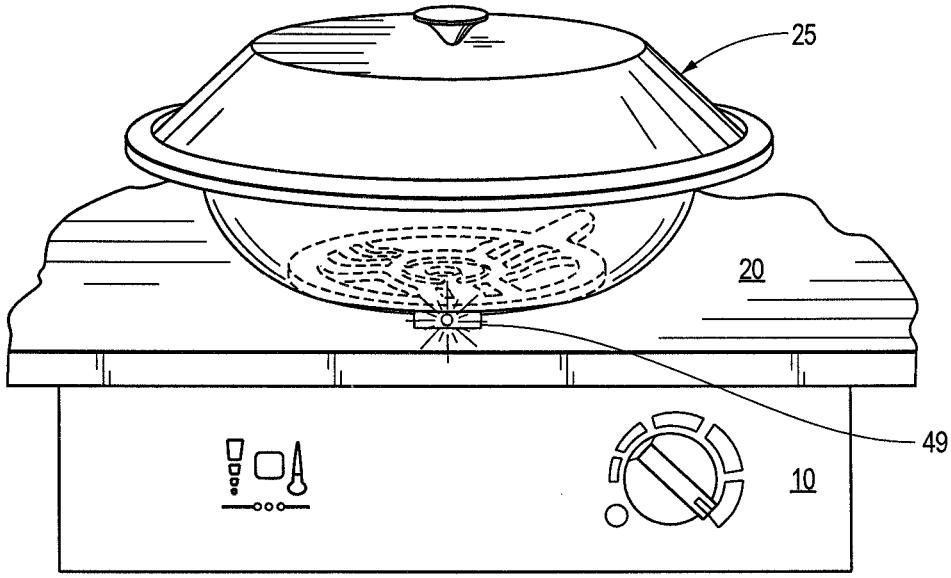
FIG. 1 is a side and top perspective view of a dish placed on a trivet, supported by stone covering an induction heating unit with a front display.

The components in the drawings are not necessarily to scale, emphasis instead being placed upon clearly illustrating the principles of the present invention.

DETAILED DESCRIPTION OF THE PREFERRED EMBODIMENT

Set forth below is a description of what are believed to be the preferred embodiments and/or best examples of the invention claimed. Future and present alternatives and modifications to this preferred embodiment are contemplated. Any alternatives or modifications which make insubstantial changes in function, in purpose, in structure, or in result are intended to be covered by the claims of this patent.

Referring to FIG. 1, in a preferred embodiment of the present invention, a suitable heater, such as magnetic induction heater unit 10, may be employed to heat various heat retention objects, such as cookware, pellets, or other objects, which may function to receive heat from indirect heating methods such as induction heating, and which may be used to heat or warm food or to maintain food in a generally heated or warmed condition. In a preferred embodiment, a cookware item such as serving dish 25, used for warming food within the dish, whether for delivery or to be served, may be used and may be located on a countertop 20. Alternatively, a food container (not shown) may be used. Alternatively, a heat retentive pellet of the type disclosed in U.S. Pat. No. 6,232,585 titled "Temperature Self-Regulating Food Delivery System" (see "pellet 86," for example), incorporated herein by reference, may be used with or instead of a cookware item. Alternatively, a pellet or other heat retention object may be employed with other food delivery or food transportation items (e.g., pizza delivery bags, etc.) for use with the present invention.

Magnetic induction heater 10 may be of the type described in pending U.S. Ser. No. 11/750,571, as well as U.S. Pat. Nos. 6,025,725 to Gershenfeld et al., and 6,320,169 and 6,953,919 to Clothier, each of which are incorporated herein by reference. Of course, it will be understood that forms of non-contact or indirect heating other than induction heating (e.g., radiant heating, etc.), or other modes of communication between a tag and a reader (e.g., optical, infrared, ultrasound, etc.) may be used in conjunction with the principles of the present invention.

Figure 2:
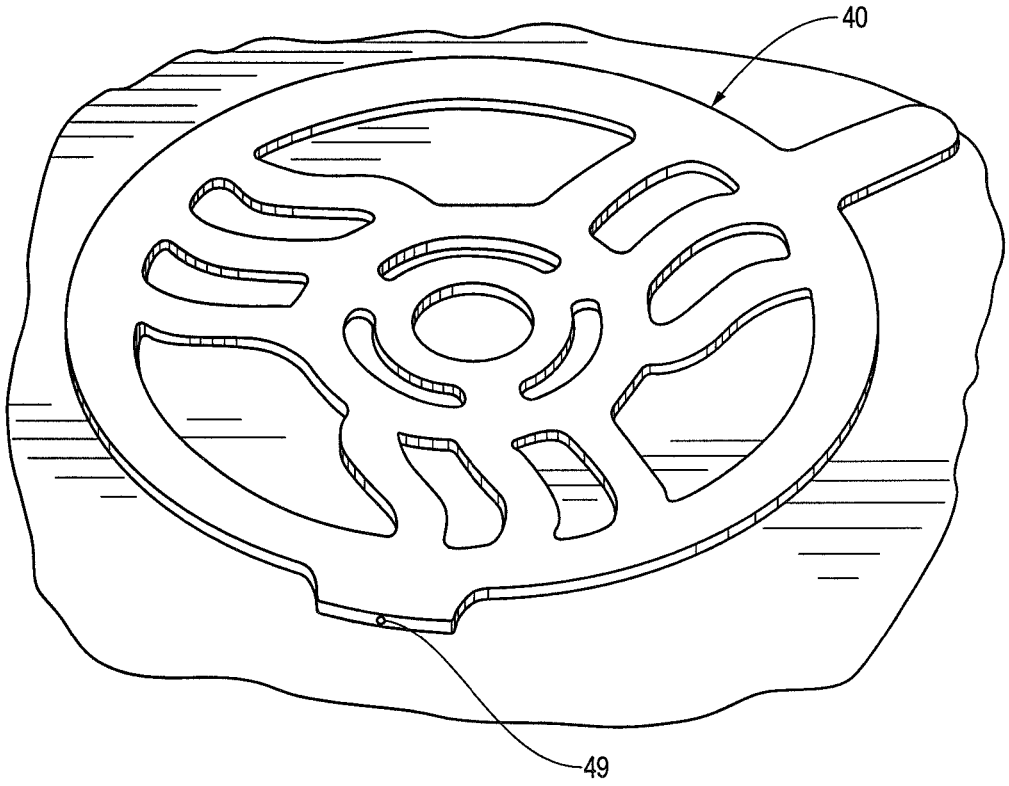
FIG. 2 is a side and top perspective view of a trivet according to the present invention.
Figure 3:
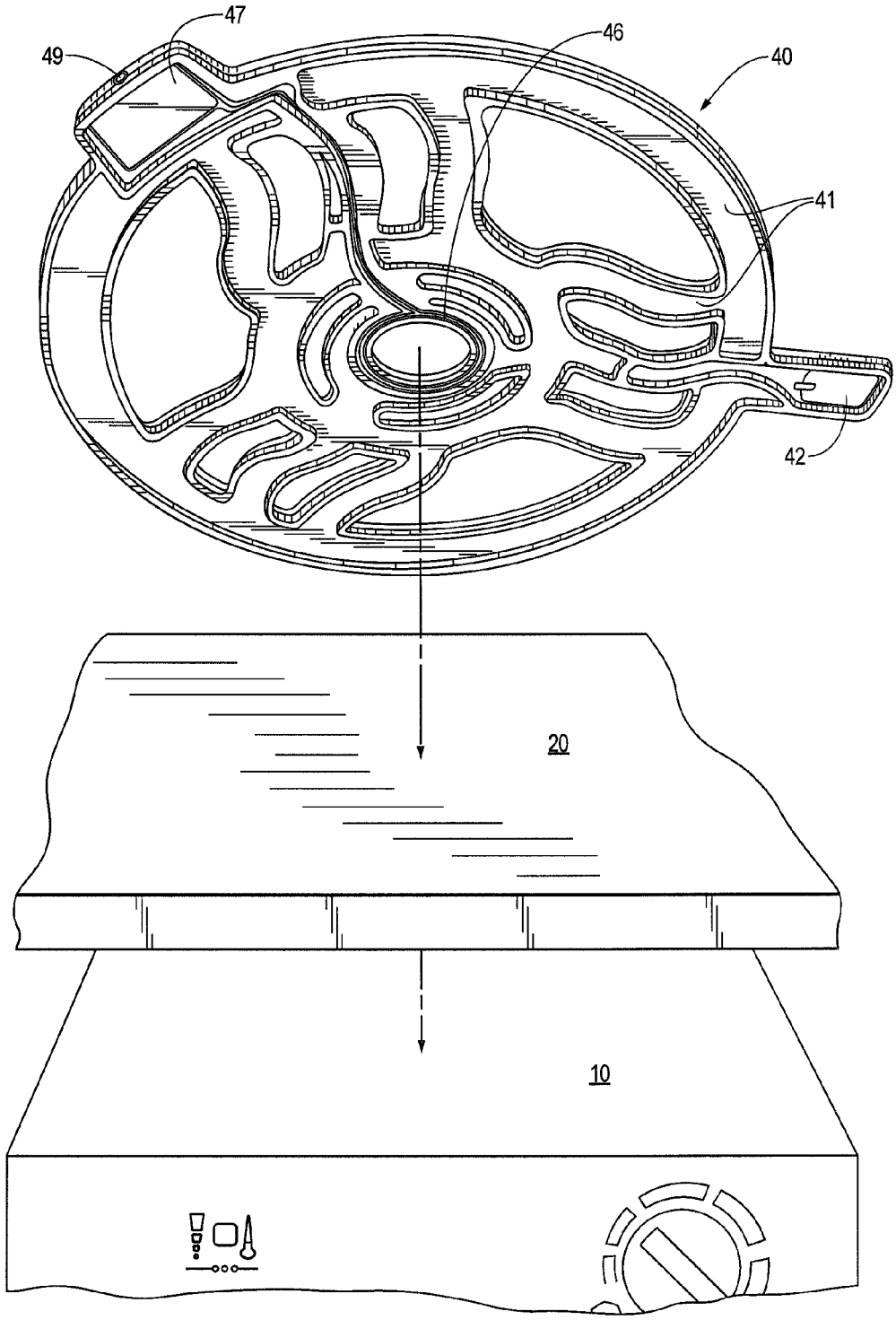
FIG. 3 is a rear view of the trivet shown in FIG. 2.

Referring to FIGS. 2-3, trivet 40, designed according to one embodiment of the present invention, is shown. Trivet 40 preferably is designed not to interfere with indirect heating, such as using the magnetic waves of induction heating, of cookware that it supports, while insulating against conducted and radiated heat that may attempt to move from the cookware and through the trivet to the countertop. Preferred trivet 40 may include a RFID temperature sensor 42 (FIG. 3), which communicates via radio waves with induction unit 10 as is well known, allowing programming of unit 10 to remotely control the temperature of the cookware.

To protect the countertop from conducted heat, trivet 40 may be designed with a relatively small vertical cross-section and/or sufficient insulating properties so that heat does not conduct from serving dish 25 back down to the countertop. The overall trivet thickness may be about ¼ inch, for example, and U-shaped channels may be designed into it, as shown.

Trivet 40 may be made of a variety of insulating materials such as wood, polycarbonate or another high temperature plastic capable of being molded. Preferably, the trivet is non-metallic so as to be transparent to the magnetic field created by induction heating.

Figure 7:
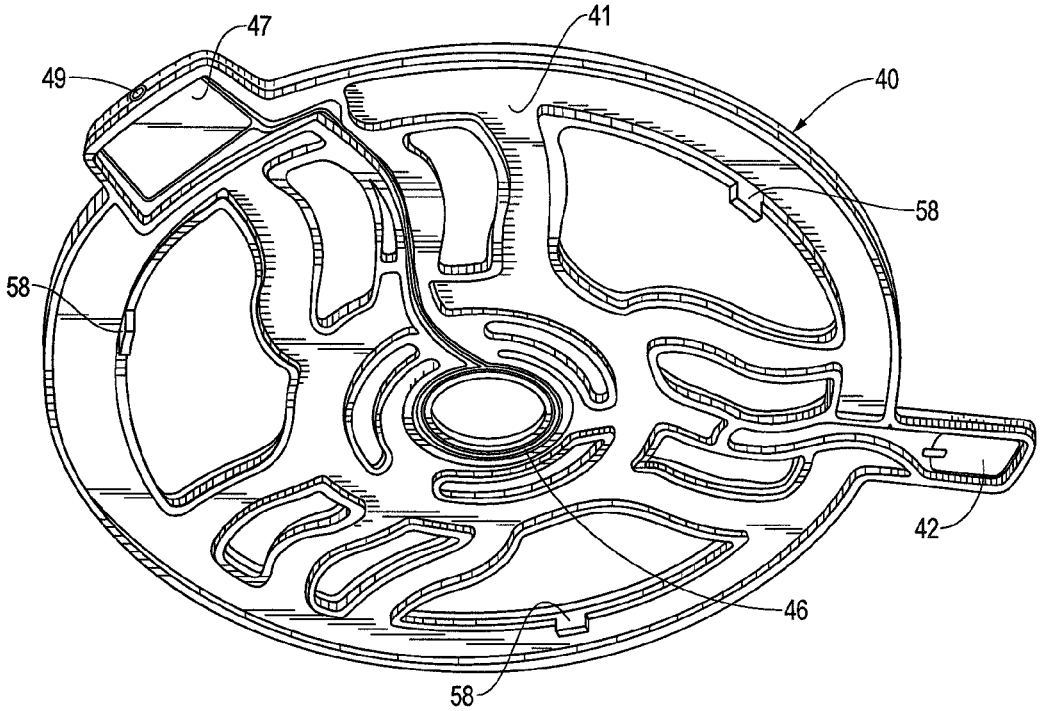
FIGS. 7 and 8 are alternative embodiments of a trivet according to the present invention.
Figure 8:
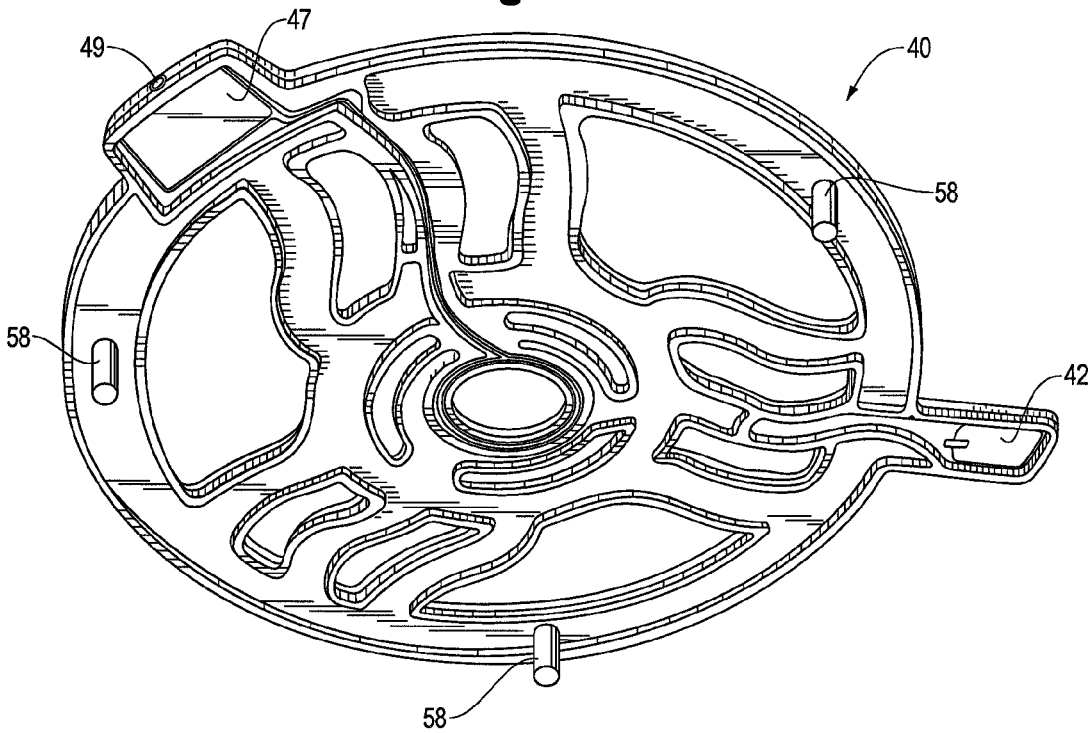

Alternative trivet designs, also designed to substantially prevent heat conduction back from the cookware to the countertop, are shown in FIGS. 7 and 8. These designs include legs 58 for limiting heat conduction from the cookware back through the trivet to the countertop. Trivets according to the present invention may have different shapes and sizes to accommodate dish sizes, or to create a custom look for a hotel logo.

It was found experimentally that using a trivet design according to FIG. 3, heat variations on stone countertops were about 100° F. less than those encountered when not using a trivet. In other words, the trivet of the present invention provides roughly about 100 degrees of an insulation factor, which is a safe operating range for countertop materials.

Still referring to FIG. 3, energy pick-up coil 46 and associated electronics 47 may be located within the U-shaped channels 41 of trivet 40. Pick-up coil 46 may be used to drive an LED 49 located on trivet 40 which may function as a locator light showing when the trivet is properly positioned over induction unit 10 (e.g., LED 49 may flash, for example, when trivet 40 is properly positioned within the magnetic field of induction heating unit 10). This may be accomplished by thresholding the energy and/or field strength from the coil to provide physical locating information, such as determining the position of the induction coil. Pick-up coil and associated electronics 46 may also be used to sense, transmit and display on the induction unit or elsewhere other user information, including whether the induction unit is currently heating the heat retention object (e.g., to show that heating is taking place, LED 49 may present a steady light). For example, this coil-originating energy may be used to power a processor which in turn may intelligently determine trivet position, power to the load, temperature detection, the content of the food dish, how long it has been warming, its humidity, or other parameters, and provide a suitable display as to any of these factors.

Figure 9:
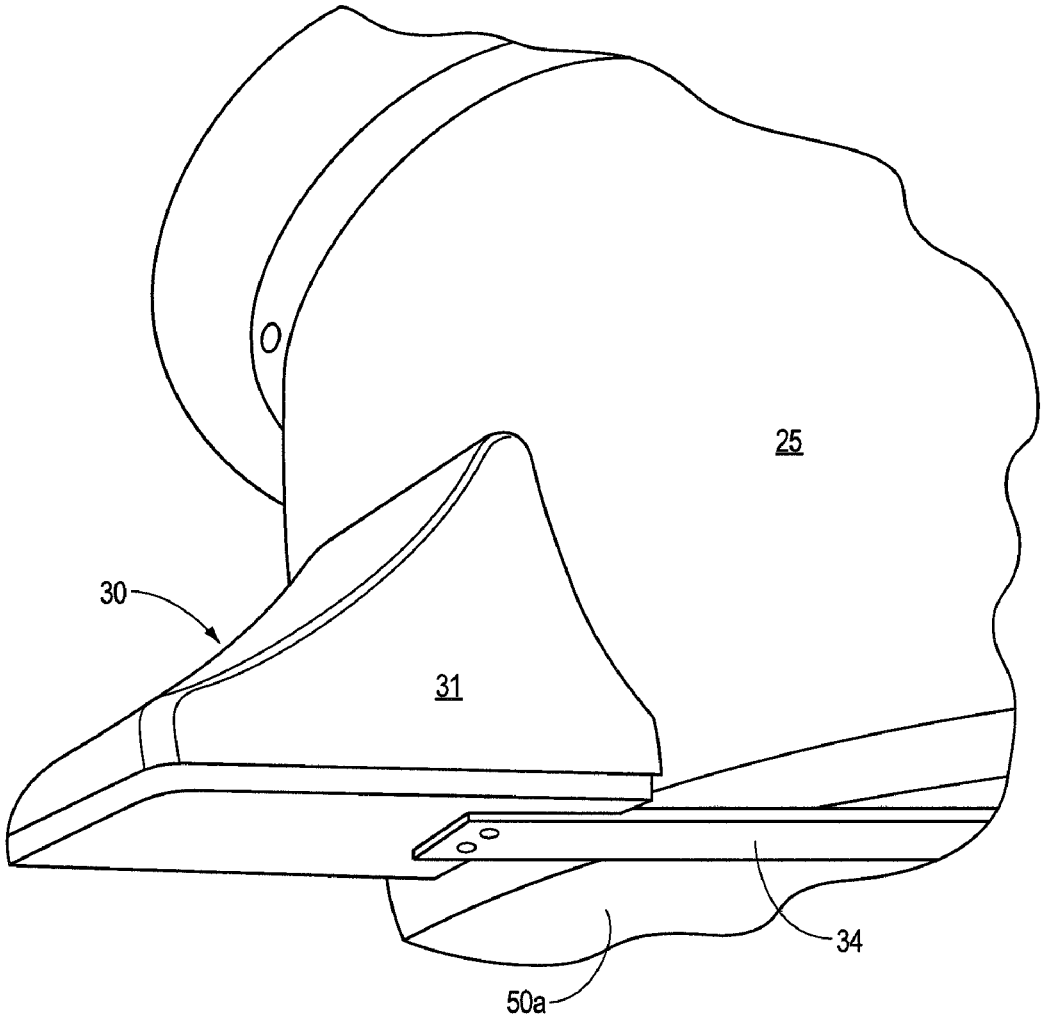
FIG. 9 is a perspective view of one embodiment of a magnetic coupler, shown attached to a serving dish, for use in induction heating applications.

Because trivet 40 may include the RFID temperature sensor, the cookware need not be outfitted with any special induction-heating-related sensors, tags or controls. Alternatively, rather than attaching the RFID temperature sensor to the trivet, the cookware may have the sensor attached to it, in any convenient manner, such as through a magnetic, removable attachment or coupler 30 as disclosed in pending U.S. Ser. No. 11/750,571, and shown in FIG. 9. Coupler 30 includes housing 31 and tongue 34, positioned below serving dish 25. Coupler 30 communicates with an induction heating unit, as disclosed in U.S. Ser. No. 11/750,571, enabling heating control over cookware item 25.

Alternatively, coupler 30 may be attached to trivet 40, which in this case may be fabricated of an insulator on its lower portion, and a metal plate portion on its upper portion to which coupler 30 may be attached, for example. This would enable heating of cookware items such as glass or ceramic dishes, for example, that cannot be heated directly with induction methods; in this case, the RFID temperature sensor contained in coupler 30 would measure the trivet temperature.

Figure 4:
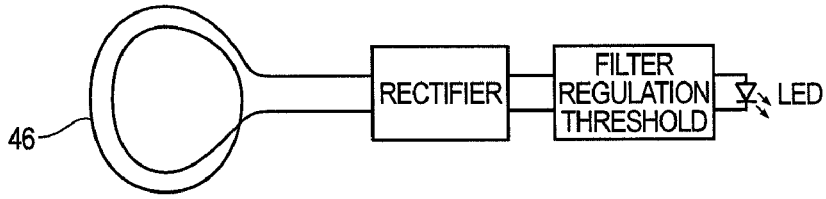
FIG. 4 is a schematic view of electrical components located in the trivet in one preferred embodiment of the invention.
Figure 5:
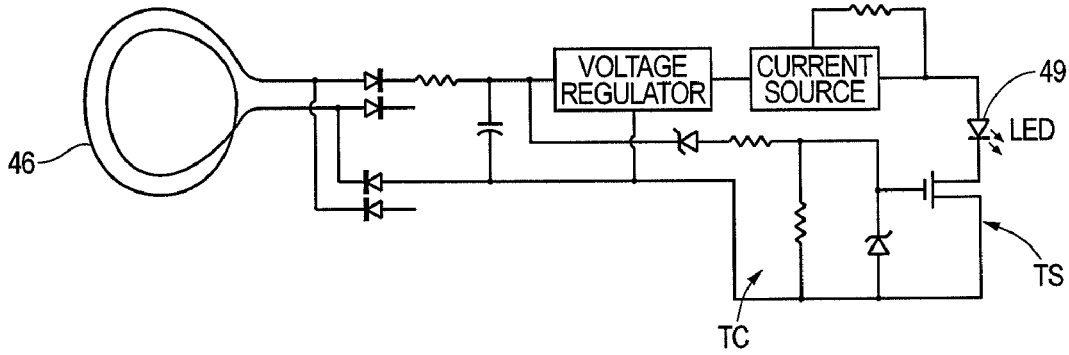
FIG. 5 is a schematic view similar to FIG. 4, showing more detailed electrical circuitry in a preferred embodiment of the invention.
Figure 6:
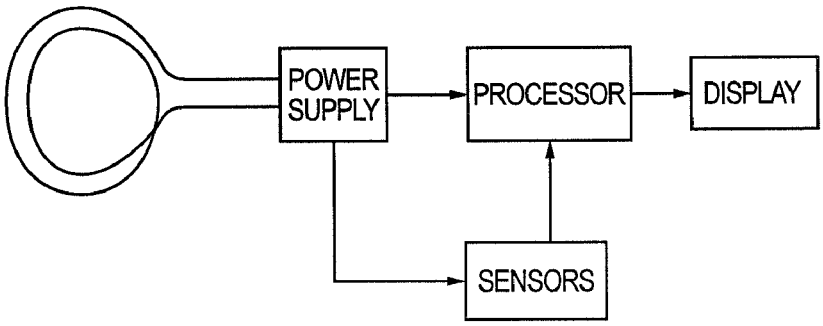
FIG. 6 is a schematic view of components present in a preferred embodiment of the invention.

Referring to FIG. 4, the electronics 47 may include electronic objects to rectify, filter and regulate the power from the coil 46 to operate LED 49. Referring to FIG. 5, circuitry for providing the rectifying, filtering and regulation functions is shown, as well as the locating circuitry for positioning the trivet and powering the LED, including "TC" or the thresholding circuit and "TS" or the transistor switch. Referring to FIG. 6, a schematic diagram is shown indicating how the induction power supply may be used to power a processor to perform a variety of functions, such as coil voltage sensing, temperature sensing, etc., and then, in turn, provide various displays such as LEDs, numerical displays, etc.

The above description is not intended to limit the meaning of the words used in the following claims that define the invention. For example, while preferred embodiments involving power induction principles applied to heating cookware have been described above, persons of ordinary skill in the art will understand that a variety of other designs still falling within the scope of the following claims may be envisioned and used. It is contemplated that future modifications in structure, function or result will exist that are not substantial changes and that all such insubstantial changes in what is claimed are intended to be covered by the claims.

We claim:

1. An apparatus for measuring and controlling the temperature of a heat retention object used in connection with an induction heating control unit to warm or to keep warm a food item, comprising:

a trivet in contact with the heat retention object, the trivet resting on a countertop, the countertop is positioned above a cooktop of the induction heating control unit, wherein the trivet acts as an insulator to limit the amount of heat transferring from the heat retention object through the trivet to the countertop, and wherein the trivet is readily useable with different heat retention objects in a variety of shapes and sizes; and a tag associated with the trivet, the tag being capable of communication with a reader associated with an induction heating control unit located below the countertop, enabling controlled heating of the heat retention object;

wherein the trivet includes electronic circuitry to facilitate the indication of its proper positioning on the countertop within the magnetic field range of the induction heating control unit, so as to allow controlled heating of an object by the induction heating control unit, and further comprising means for indicating to a user when the trivet is properly positioned, wherein the indicating means is located on the trivet, is powered by the magnetic field of the induction heating control unit, and is in electrical communication with the trivet electronic circuitry.

2. The apparatus of claim 1, further comprising a temperature sensor associated with the tag and in contact with the heat retention object, enabling the tag to transmit the temperature of the heat retention object to the induction heating control unit.

3. The apparatus of claim 2, wherein the trivet includes channels and/or cavities.

4. The apparatus of claim 3, wherein the electronic circuitry located on the trivet is located within the channels or cavities.

5. The apparatus of claim 2, further comprising processor means communicating with sensors and displays to indicate operating conditions of the heating control unit or the heat retention object to the user.

6. The apparatus of claim 1, wherein the heating control unit comprises an induction heating unit which transmits magnetic waves to the heat retention object.

7. The apparatus of claim 6, wherein the tag comprises an RFID tag and the reader comprises an RFID reader.

8. The apparatus of claim 6, wherein the indicating means comprises a visual display showing a user when the trivet is properly positioned within the magnetic field of the induction heating unit.

9. The apparatus of claim 8, wherein the indicating means also displays whether the induction heating unit is currently heating the heat retention object, and the indicating means comprises an LED.

10. The apparatus of claim 1, wherein the heat retention object comprises an item of cookware.

11. The apparatus of claim 1, wherein the heat retention object comprises either a food container or a heat retentive pellet.

12. The apparatus of claim 1, wherein the countertop is made from one or more of the following materials: stone; composites; formica; glass; ceramic; or wood.

13. An apparatus including an induction heating control unit positioned beneath a countertop for measuring and controlling the temperature of a heat retention object to be indirectly heated, comprising:

a trivet supporting the heat retention object, the trivet resting on the countertop, wherein the countertop is positioned above a cooktop of the induction heating control unit, and wherein the trivet acts as an insulator to limit the amount of conducted and radiated heat transferring from the heat retention object through the trivet to the countertop, and the trivet is readily useable with different heat retention objects in a variety of shapes and sizes;

wherein the trivet has associated with it an RFID tag, the tag being capable of communication with an RFID reader associated with the induction heating control unit; and wherein the trivet includes electronic circuitry to facilitate the indication of its proper positioning on the countertop within the magnetic field range of the induction heating control unit, so as to allow controlled heating of an object by the induction heating control unit, and further comprising display means for visually indicating to a user when the trivet is properly positioned, wherein the display means is located on the trivet, is powered by the magnetic field of the induction heating control unit, and is in electrical communication with the trivet electronic circuitry.

14. The apparatus of claim 13, wherein the heat retention object comprises either a food container or an item of cookware.

15. The apparatus of claim 13, wherein the trivet includes an insulating lower portion and a metallic upper portion to which the RFID tag is attached.

16. A system for measuring and controlling temperatures of heat retention objects used to warm or to keep warm food items, using an induction heating control unit, comprising:

a trivet supporting the heat retention object, the trivet resting on a countertop, wherein the countertop is positioned above a cooktop of the induction heating control unit, and wherein the trivet acts as an insulator to limit heat transferring from the heat retention object through the trivet to the countertop, and the trivet is readily useable with different heat retention objects in a variety of shapes and sizes;

a tagging object associated with either the trivet or the heat retention object; and a heater control unit in communication with a reader capable of receiving information from the tagging object, enabling directly controlled heating of either the trivet or the heat retention object;

wherein the trivet includes electronic circuitry to facilitate the indication of its proper positioning on the countertop, so as to allow controlled heating of an object by the heating control unit, and further comprising display means for visually indicating to a user when the trivet is properly positioned, and wherein the display means is located on the trivet, is powered by the magnetic field of the induction heating control unit, and is in electrical communication with the trivet electronic circuitry.

17. The system of claim 16, wherein the heater control unit employs induction heating to heat either the trivet or the heat retention object using information provided by the tagging object that has been communicating with the reader.

18. The system of claim 16, wherein the heat retention object comprises either a food container or an item of cookware.

* * * * *